US010012357B2

(12) United States Patent
Lin et al.

(10) Patent No.: US 10,012,357 B2
(45) Date of Patent: Jul. 3, 2018

(54) LIGHT EMITTING DIODE HEADLIGHT

(71) Applicant: Lextar Electronics Corporation, Hsinchu (TW)

(72) Inventors: Shih-Kai Lin, Tainan (TW); Yu-Min Lin, New Taipei (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 268 days.

(21) Appl. No.: 14/975,849

(22) Filed: Dec. 20, 2015

(65) Prior Publication Data

US 2016/0215944 A1 Jul. 28, 2016

(30) Foreign Application Priority Data

Jan. 28, 2015 (TW) ..... 104102866 A
Jun. 11, 2015 (TW) ..... 104118968 A

(51) Int. Cl.

| | |
|---|---|
| ***F21S 8/10*** | (2006.01) |
| ***F21S 41/143*** | (2018.01) |
| ***F21S 41/255*** | (2018.01) |
| ***F21S 41/43*** | (2018.01) |
| ***F21S 45/47*** | (2018.01) |

(52) U.S. Cl.

CPC ..... *F21S 41/143* (2018.01); *F21S 41/255* (2018.01); *F21S 41/43* (2018.01); *F21S 45/47* (2018.01)

(58) Field of Classification Search

CPC ... F21S 48/145; F21S 48/1258; F21S 48/1154
See application file for complete search history.

(56) References Cited

U.S. PATENT DOCUMENTS

| | | | | |
|---|---|---|---|---|
| 5,902,039 | A | 5/1999 | Futami | |
| 8,092,059 | B2 * | 1/2012 | Yamagata | F21S 48/1159 362/517 |
| 8,506,146 | B2 | 8/2013 | Kinoshita et al. | |
| 2003/0107901 | A1 | 6/2003 | Tokoro et al. | |
| 2005/0018443 | A1 * | 1/2005 | Tsukamoto | F21S 48/1154 362/539 |
| 2010/0046243 | A1 | 2/2010 | Yatsuda | |

(Continued)

FOREIGN PATENT DOCUMENTS

| | | | |
|---|---|---|---|
| CN | 103883957 | A | 6/2014 |
| DE | 102008046107 | A1 | 4/2009 |

(Continued)

*Primary Examiner* — Alexander Garlen
*Assistant Examiner* — Eric T Eide
(74) *Attorney, Agent, or Firm* — CKC & Partners Co., Ltd.

(57) ABSTRACT

An LED headlight includes a lens, a heat sink, at least one LED module and a shelter. The lens includes a focal length and a focal plane, wherein the focal plane extends from a focal point of the lens and is perpendicular to an optical axis of the lens. The heat sink is arranged along the optical axis of the lens, and a distance between the heat sink and the lens is greater than a distance between the focal point and the lens. The at least one LED module is arranged along the optical axis of the lens and in contact with the heat sink, a distance between the LED module and the lens is greater than the distance between the focal point and the lens. The shelter is arranged along the focal plane and configured to block light emitted from the LED module.

10 Claims, 5 Drawing Sheets

(56) References Cited

U.S. PATENT DOCUMENTS

| | | | | |
|---|---|---|---|---|
| 2012/0140505 | A1* | 6/2012 | Tsukamoto | F21S 48/1104 362/516 |
| 2012/0275168 | A1* | 11/2012 | Kloos | F21S 48/145 362/351 |
| 2013/0003402 | A1* | 1/2013 | Chao | F21S 48/1154 362/520 |
| 2014/0175978 | A1* | 6/2014 | Kobayashi | F21S 48/1195 315/82 |
| 2016/0238210 | A1* | 8/2016 | Masuda | B60Q 1/0017 |

FOREIGN PATENT DOCUMENTS

| | | | |
|---|---|---|---|
| DE | 102012224345 | A1 | 6/2014 |
| EP | 2522897 | A2 | 11/2012 |
| JP | 2009064629 | A | 3/2009 |
| JP | 2009134964 | A | 6/2009 |
| TW | I258550 | B | 7/2006 |
| TW | 200726668 | A | 7/2007 |
| TW | I296585 | B | 5/2008 |
| TW | 200838739 | A | 10/2008 |
| TW | 200938413 | A | 9/2009 |
| TW | 201432187 | A | 8/2014 |

* cited by examiner

LIGHT EMITTING DIODE HEADLIGHT

RELATED APPLICATIONS

This application claims priority to Taiwanese Application Serial Number 104102866, filed Jan. 28, 2015, and Taiwanese Application Serial Number 104118968, filed Jun. 11, 2015, which are herein incorporated by reference.

BACKGROUND

Field of Invention

The present disclosure relates to an LED headlight.

Description of Related Art

At present, the traditional halogen bulbs are still used as light sources for vehicular and automotive headlights. In headlights of PES (Poly-Ellipsoid System), an elliptical reflector is necessary and functional. The elliptical reflector has two focal points. When a light source is located on the first focal point of the elliptical reflector, light beams emitted from the center of the light source can be reflected by the inner curved surface of the elliptical reflector and then pass the second focal point.

However, the drawbacks of halogen bulbs are short life, low luminous efficacy and high power consumption. With the development of HID (High-Intensity Discharge) bulbs and LEDs (Light Emitting Diode), halogen bulbs have been gradually replaced by these light sources in vehicular and automotive headlights. Compared with HID bulbs, LEDs have the advantages of higher luminous efficacy, lower driving voltages and faster response time.

SUMMARY

An aspect of the disclosure provides an LED headlight.

According to one or more embodiments of this disclosure, an LED headlight includes a lens, a heat sink, at least one LED module and a shelter. The lens has a focal length and a focal plane, wherein the focal plane extends from a focal point of the lens and is perpendicular to an optical axis passing through the geometrical center of the lens. The heat sink is located along the optical axis of the lens, and a distance between the heat sink and the lens is greater than a distance between the focal point and the lens. The at least one LED module is located along the optical axis of the lens and in contact with the heat sink, a distance between the LED module and the lens is greater than the distance between the focal point and the lens. The shelter is located on the focal plane and configured to isolate part of light beams emitted from the LED module. The LED module has a light-emitting surface having a maximum width (L), which satisfies $0.0351F_L \leq L \leq 0.7279F_L$, wherein L represents the maximum width of the light-emitting surface, $F_L$ represents the focal length of the lens.

According to one or more embodiments of this disclosure, there is a virtual line formed between "a first intersection of an outermost emitted light of the LED module and the focal plane of the lens" and "a second intersection of an object principal plane and the optical axis of the lens". An angle of intersection between the virtual line and the optical axis of the lens satisfies an equation below:

$$2F_L \tan\theta = L + 2d \tan\theta_L$$

Wherein θ represents half of the angle of intersection between the virtual line and the optical axis of the lens, θL represents half of the viewing angle of the LED module; d represents a distance between the focal plane and the LED module.

According to one or more embodiments of this disclosure, the distance between the focal plane and the LED module is smaller than or equal to one fifth of the focal length of the lens.

According to one or more embodiments of this disclosure, the distance (d) between the focal plane and the LED module satisfying: $(2F_L \tan\theta - L)/2 \tan 65° \leq d \leq (2F_L \tan\theta - L)/2 \tan 55°$.

According to one or more embodiments of this disclosure, half of the viewing angle of the LED module ranges from about 55° to about 65°.

According to one or more embodiments of this disclosure, half of the angle of intersection between the virtual line and the optical axis of the lens is about 20°.

According to one or more embodiments of this disclosure, the focal length of the lens ranges from about 44.5 millimeters to about 57.5 millimeters.

According to one or more embodiments of this disclosure, the lens has a Numerical Aperture ranging from about 0.5 to about 0.55.

According to one or more embodiments of this disclosure, when the LED module emits light along the optical axis of the lens onto a projected plane, the luminous intensity measured on an intersection of the optical axis of the lens and the projected plane is smaller than or equal to 1700 candelas.

According to one or more embodiments of this disclosure, when the LED module emits light along the optical axis of the lens onto a projected plane, a luminous intensity measured on the intersection of the optical axis of the lens and the projected plane is greater than or equal to 5100 candelas.

According to one or more embodiments of this disclosure, the light pattern formed onto the projected plane has a cut-off line. An included angle between the cut-off line and a horizontal line on the projected plane is about 15°.

According to one or more embodiments of this disclosure, an LED headlight includes a lens, a heat sink, at least one LED module and a shelter. The lens has a focal length and a focal plane, wherein the focal plane extends from a focal point of the lens and is perpendicular to an optical axis passing through the geometrical center of the lens. The heat sink is located along the optical axis of the lens, and a distance between the heat sink and the lens is greater than a distance between the focal point and the lens. The at least one LED module is located along the optical axis of the lens and in contact with the heat sink, a distance between the LED module and the lens is greater than the distance between the focal point and the lens. The shelter is located on the focal plane and configured to block part of light beams emitted from the LED module. There is a virtual line formed between "the first intersection of an outermost emitted light of the LED module and the focal plane of the lens" and "the second intersection of an object principal plane and the optical axis of the lens". An angle of intersection between the virtual line and the optical axis of the lens is defined. A distance (d) between the focal plane and the LED module satisfies: $(2F_L \tan\theta - L)/2 \tan 65° \leq d \leq (2F_L \tan\theta - L)/2 \tan 55°$, wherein $F_L$ represents the focal length of the lens, θ represents half of the angle of intersection between the virtual line and the optical axis of the lens, d represents a distance between the focal plane of the lens and the LED module, L represents a maximum width of an light-emitting surface on the LED module.

Accordingly, one or more embodiments equipped with the LED headlight disclosed herein consume lower power. In addition, the LED module has a light-emitting surface, which directly confronts a corresponding lens; thereby omitting the reflector can further reduce the volume of the entire LED headlight.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
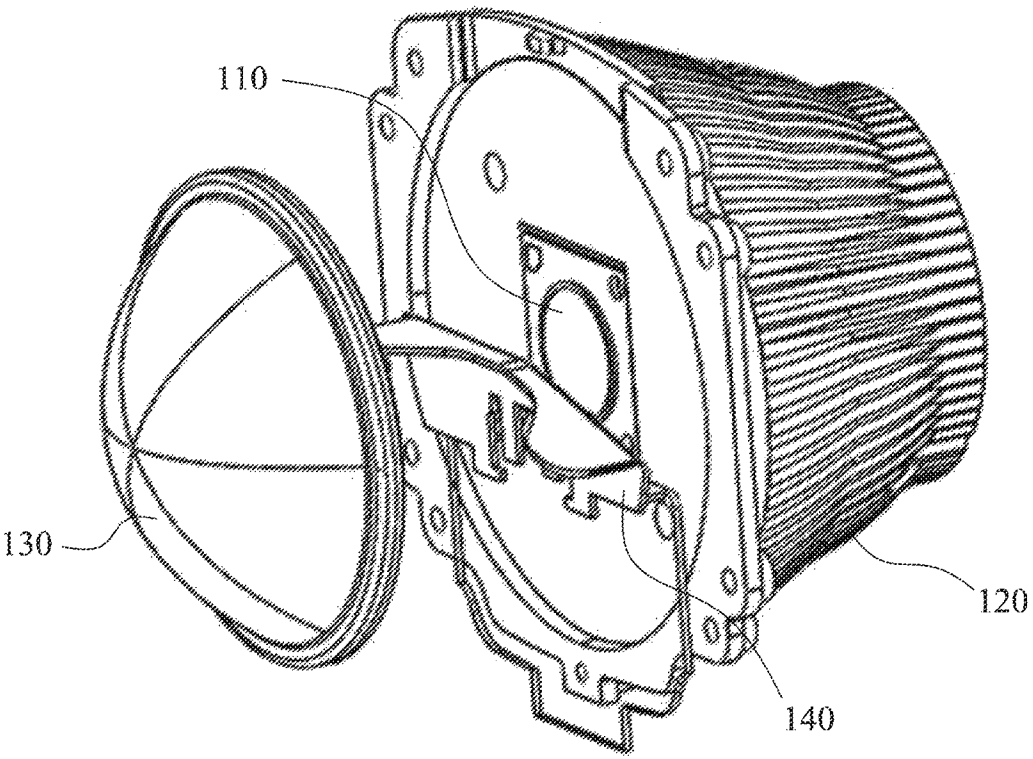
FIG. 1 illustrates a perspective view of an LED headlight according to one embodiment of this disclosure.

Reference will now be made in detail to the present embodiments of the disclosure, examples of which are illustrated in the accompanying drawings. Wherever possible, the same reference numbers are used in the drawings and the description to refer to the same or like parts.

As used herein, the wording on the "substantially", "around", "about" or "approximately" shall mean twenty percent more or less of a given value, preferably within 10 percent more or less of the given value, and more preferably less than five percent of more or less of the given value. If not explicitly stated in the text, the value to which it refers are regarded as approximations, namely as "substantially", "about", "approximately" or "nearly" indicated.

Disclosed herein is an LED headlight, in which the LED module emits light beams directly onto a corresponding lens. Therefore, the following embodiments enable smaller LED headlight volume without using any reflector.

Figure 2:
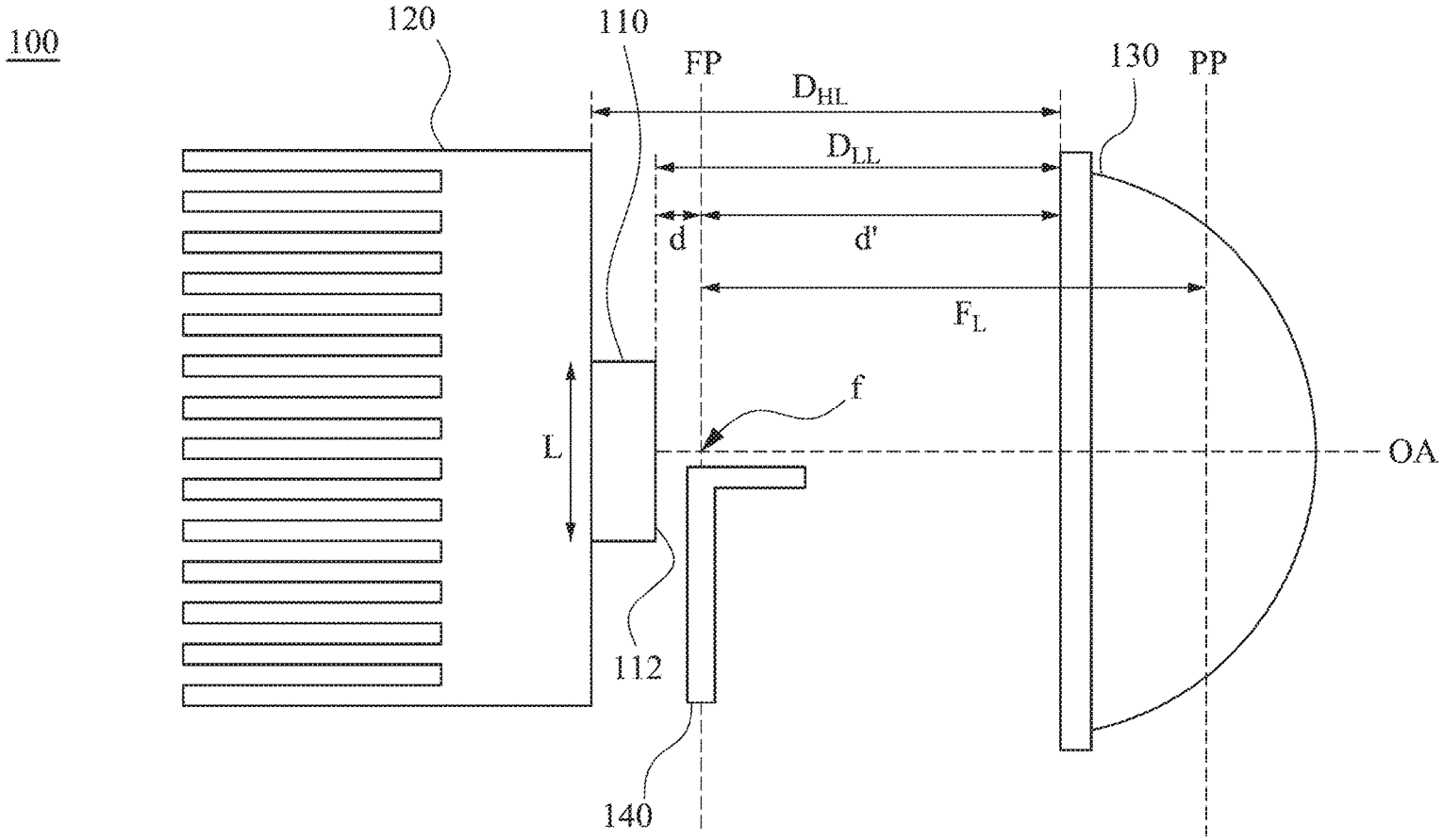
FIG. 2 illustrates a side view of an LED headlight according to another embodiment of this disclosure.

FIG. 1 illustrates a perspective view of an LED headlight 100 according to one embodiment of this disclosure, and FIG. 2 illustrates a side schematic view of an LED headlight 100 in FIG. 1 (i.e., FIG. 2 shows the main parts' profiles, not the actual proportions or shapes depicted). As illustrated, the LED headlight 100 includes at least one LED module 110, a heat sink 120, a lens 130 and a shelter 140. The lens 130 has an optical axis OA, a focal length $F_L$, a focal point f, a focal plane FP and an object principal plane PP, wherein the focal length $F_L$ is a distance between the object principal plane PP of the lens 130 and the focal point f of the lens 130, and the focal plane FP extends from the focal point f of the lens 130 and is perpendicular to an optical axis OA passing through a geometrical center of the lens 130. The heat sink 120 is located along the optical axis OA, and a distance $D_{HL}$ between the heat sink 120 and the lens 130 is greater than a distance d' between the focal point f and the lens 130. The LED module 110 is installed along the optical axis OA of the lens 130, and positioned in contact with the heat sink 120. A distance $D_{LL}$ between the LED module 110 and the lens 130 is greater than the distance d' between the focal point f and the lens 130. In this embodiment, the LED module 110 has a light-emitting surface 112. The shelter 140 is located along the focal plane FP, and is used to selectively block light beams emitted from the LED module. When the shelter 140 blocks light beams emitted from the LED module, the light emitted from the LED headlight 100 is irradiated to a surface (such as the ground) so as to form a cut-off line thereon. The cut-off line is a line projected on the surface to make a distinction between a bright zone and a dark zone of the light pattern, and used to avoid the harm of the glare to the passerby.

As illustrated in FIG. 1 and FIG. 2, the light beams emitted from the light-emitting surface 112 confronts onto the lens 130 directly, and any light reflecting component (e.g., a reflector) is not necessary to apply within the LED headlight 100. Therefore, the total volume of the LED headlight 100 in this embodiment can become relatively smaller to fit the future market requirement of vehicle headlights.

Figure 3:
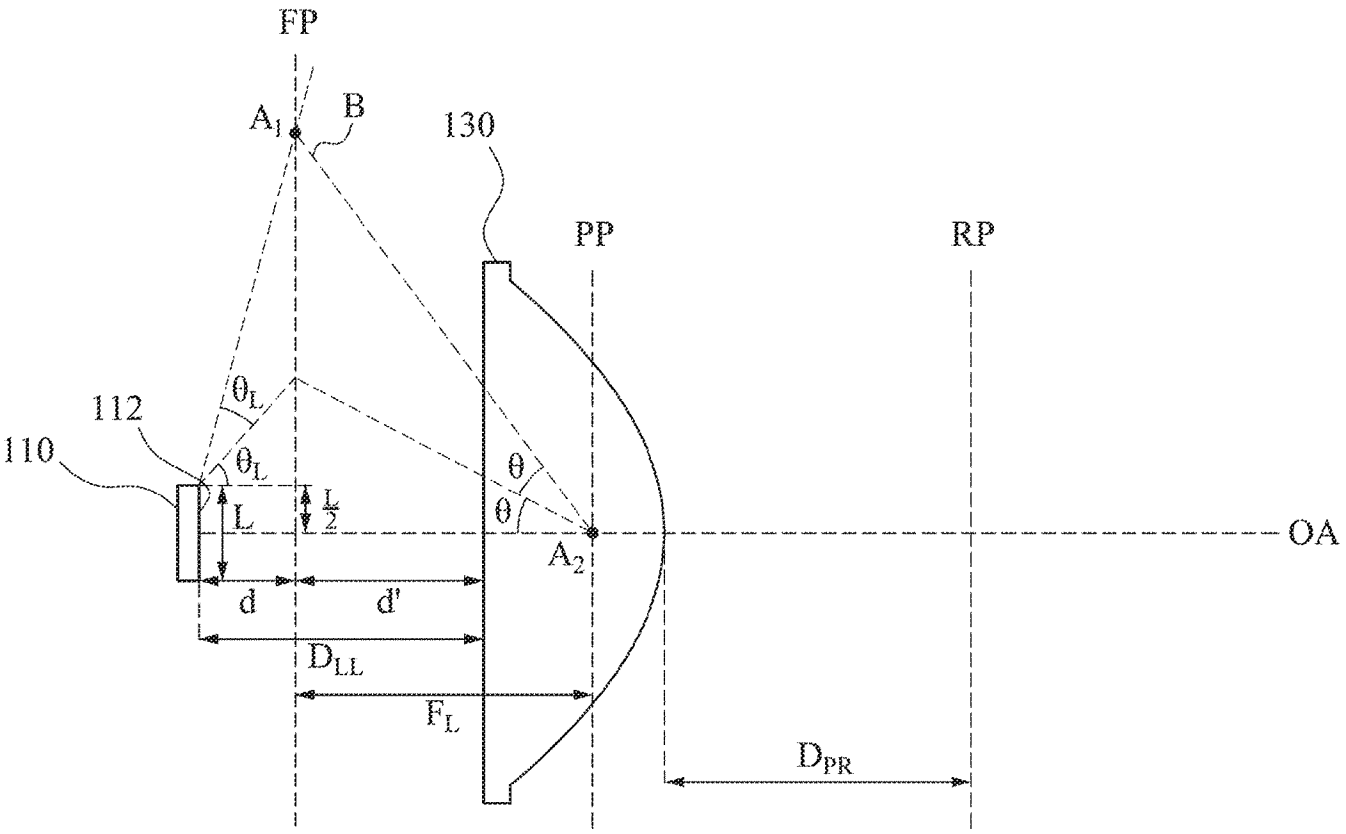
FIG. 3 illustrates key components of an LED headlight according to another embodiment of this disclosure.

FIG. 3 illustrates key components of the LED headlight 100 according to another embodiment of this disclosure, wherein the shelter 140 and heat sink 120 as illustrated in FIG. 1 and FIG. 2 are omitted. Referring to FIGS. 1-3, the light-emitting surface 112 of the LED module 110 is equipped with a maximum width L. In this embodiment, the maximum width L can be a distance between two opposite sides of the light-emitting surface 112, and the maximum width L and the focal length $F_L$ of the lens 130 satisfy the formula: $0.0351F_L \leq L \leq 0.7279F_L$.

Figure 4:
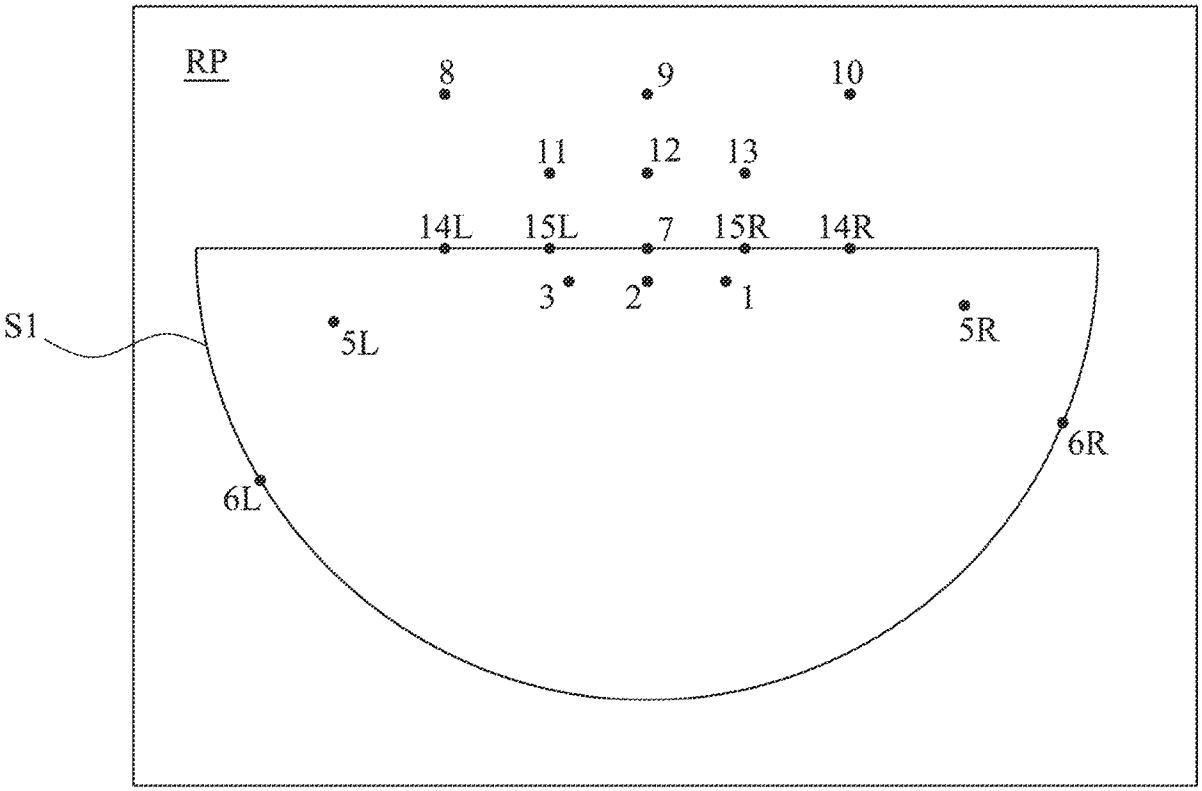
FIG. 4 illustrates a light pattern of an LED headlight according to another embodiment of this disclosure.

FIG. 4 illustrates a light pattern of an LED headlight 100 according to another embodiment of this disclosure. As illustrated in this embodiment, the light emitted from the light-emitting surface 112 of the LED module 110 is refracted by the lens 130 along a distance $D_{PR}$ and onto the projection surface RP so as to obtain a light pattern S1 (e.g., an approximately semicircular pattern) as illustrated in FIG. 4. In practice, the LED module 110 has a circular light-emitting surface, which is driven by 33 volt, 450 mA to emit along the distance $D_{PR}$ (25 meters) and onto the projection surface RP. The following Table 1 lists measurement results on the projection surface RP in this embodiment and compared with ECE's regulatory requirements (for motorcycle), wherein the measured point 7 is located at an intersection of the optical axis OA of the lens 130 and the projection surface RP, and its luminous intensity requirement is smaller than or equal to 1700 candelas.

TABLE 1

| Measured points | | ECE's Light intensity requirements (candelas) | Light intensity (candelas) measured | |
|---|---|---|---|---|
| 1 | | 2000~13750 | 7136 | |
| 2 | | ≥2450 | 8680 | |
| 3 | | 2000~13750 | 7198 | |
| 7 | | ≤1700 | 944 | |
| 4L | 4R | ≤900 | 258 | 262 |
| 5L | 5R | ≥550 | 646 | 603 |
| 6L | 6R | ≥150 | 307 | 298 |
| 8 + 9 + 10 | | ≥150 | 309 | |
| 11 + 12 + 13 | | ≥300 | 500 | |
| 14L | 14R | ≥50 | 619 | 475 |
| 15L | 15R | 100-900 | 828 | 778 |

As shown in Table 1, all measured points on the projection surface R, which is irradiated by the LED headlight 100 by an interval of 25 meters, are in compliance with ECE regulations for luminous intensity of automotive passing beam (low beam).

Figure 5:
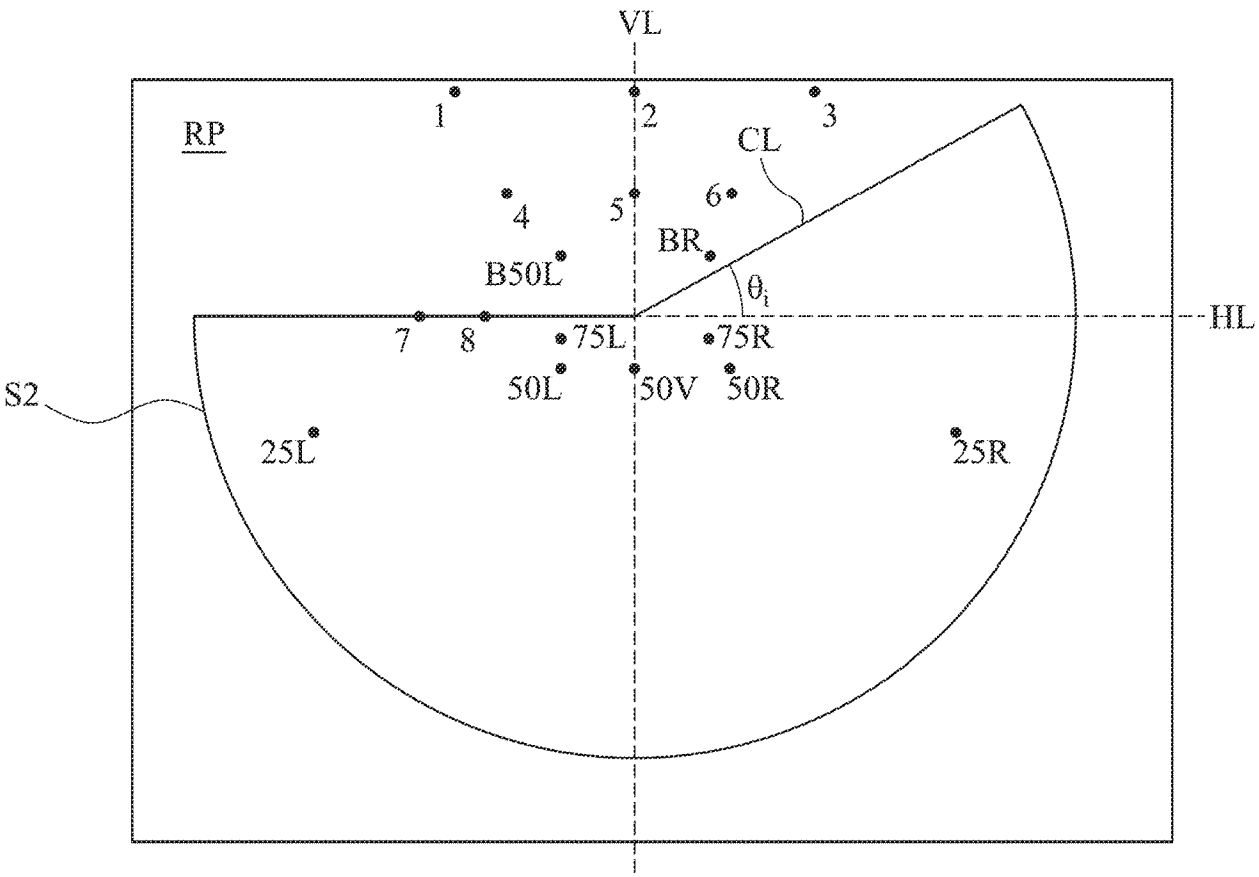
FIG. 5 illustrates a light pattern of an LED headlight according to still another embodiment of this disclosure.

FIG. 5 illustrates a light profile of the LED headlight 100 according to still another embodiment of this disclosure. This embodiment is different from the embodiment of FIG. 4 that the light beams emitted from the LED module 110 is refracted by the lens 130 onto the projection surface RP so as to obtain a light pattern S2, which has a cut-off line CL. The cut-off line CL is a line on the projection surface to make a distinction between a bright zone and a dark zone of the light pattern S2, and the cut-off line CL is formed mainly by using the shelter 140 to block part of light emitted from the LED module (referring to FIG. 1 and FIG. 2). As illustrated in the embodiment of FIG. 5, the horizontal line HL and the vertical line VL divides the projection plane RP into four quadrants, the cutoff line CL is in the first quadrant, and an included angle $\theta_i$ is formed between the cut-off line CL and the horizontal line HL so as to avoid the harm of the glare (generated by the LED headlight 100) to the passerby. In practice, the angle $\theta_i$ between the cut-off line CL and the horizontal line HL is, but not being limited to, about 15°.

Referring both to FIG. 5 and the following table 2, "table 2" lists measurement results on the projection surface RP in this embodiment and compared with ECE's regulatory requirements (for automobiles). In this embodiment, the LED module 110 is driven by 35 volt, 1 A to emit along the distance $D_{PR}$ (25 meters) and onto the projection surface RP, wherein the measured point 50V is located at an intersection of the optical axis OA of the lens 130 and the projection surface RP, and its luminous intensity requirement is smaller than or equal to 5100 candelas.

TABLE 2

| Measured points | ECE's Light intensity requirements (candelas) | Light intensity (candelas) measured |
|---|---|---|
| B50L | ≤350 | 342 |
| BR | ≤1750 | 1373 |
| 75R | ≥10100 | 11430 |
| 75L | ≤10600 | 6368 |
| 50L | ≤13200 | 7971 |
| 50R | ≥10100 | 12000 |
| 50V | ≥5100 | 11145 |
| 25L | ≥1700 | 1895 |
| 25R | ≥1700 | 4450 |
| 1 + 2 + 3 | ≥190 | 878 |
| 4 + 5 + 6 | ≥375 | 1664 |
| 7 | ≥65 | 375 |
| 8 | ≥125 | 1361 |

As shown in Table 2, all measurement results of test points on the projection surface R, which is irradiated by the LED headlight 100 by an interval of 25 meters, are in compliance with ECE regulations for luminous intensity of automotive passing beam.

Referring to FIG. 3, in this embodiment, a first intersection $A_1$ is formed of the focal plane FP and the emitted light along the (outermost) viewing angle ($2\theta_L$) of the LED module 110, and a second intersection $A_2$ is formed of the object principal plane PP of the lens 130 and the optical axis OA. A virtual line B is formed between first intersection $A_1$ and the second intersection $A_2$. As illustrated in FIG. 3, an angle ($2\theta$) is formed between the virtual line B and the optical axis OA of the lens 130. The angle ($2\theta$) is also referred as "angle of intersection", and half of the "angle of intersection" is $\theta$. In addition, a distance between the focal plane FP and the LED module 110 is "d", and half of the (full) viewing angle of the LED module 110 is $\theta_L$. The (full) viewing angle ($2\theta_L$) of the LED module 110 is an angle of intersection between the outermost emitted light of the LED module 110 and the optical axis OA of the lens 130. Therefore, the focal length $F_L$ of the lens 130, the maximum width L of the light-emitting surface 112, half of the "angle of intersection" $\theta$, and half of the (full) viewing angle $\theta_L$ forms a relationship which satisfies the following equation (1):

$$2F_L \tan\theta = L + 2d \tan\theta_L \quad (1)$$

The equation (1) can be obtained from two triangles at two sides of the focal plane FP in FIG. 3 sharing a common edge (i.e., FP). As illustrated in FIG. 3, $F_L \tan\theta = L/2 + d \tan\theta_L$, and the equation (1) can be obtained by doubling on both sides of the equation. With this regard, the LED headlight 100 can be designed in accordance with the equation (1).

Referring to FIG. 3, in this embodiment, a distance d between the focal plane FP and the LED module 110 also satisfies the following equation (2):

$$0 \le d \le F_L/5 \quad (2)$$

When an upper threshold and a lower threshold of the equation (2) are put into the equation (1), another two equations: $L = 2F_L \tan\theta$ and $L = 2F_L \tan\theta - (2F_L/5)\tan\theta_L$ are found. The maximum width L of the light-emitting surface 112 of the LED module 110 satisfies the following equation (3):

$$2F_L \tan\theta - (2F_L/5)\tan\theta_L \le L \le 2F_L \tan\theta \quad (3)$$

With this regard, the maximum width L of the light-emitting surface 112 of the LED module 110 is affirmative by inputting the focal length $F_L$ of the lens 130, half of the "angle of intersection" $\theta$, and half of the (full) viewing angle $\theta_L$ into the equation (3) so as to simplify the design process of the LED headlight 100 in compliance with ECE regulations. In addition, the LED headlight 100 in this embodiment is able to become smaller because the distance "d" between the focal plane FP and the LED module 110 is equal to or less than $F_L/5$ ($d \le F_L/5$).

In an embodiment, the LED module 110 is in compliance with the characteristics of Lambertian light source, and its half of the viewing angle $\theta_L$ of the LED module 110 ranges from about 55° to about 65°. In particular, half of the viewing angle $\theta_L$ of the LED module 110 is about 60°, and $\tan\theta_L$ is about 1.732. In addition, in compliance with regulatory requirements, half of the "angle of intersection" $\theta$ is about 20°, and $\tan\theta$ is about 0.364. Inputting $\tan\theta_L = 1.732$ and $\tan\theta = 0.364$ into the equation (3), an expression of relation between L and $F_L$ can be found, that is $0.0351F_L \le L \le 0.7279F_L$.

In the above-discussed embodiment, the distance "d" between the focal plane FP and the LED module 110 is equal to or less than $F_L/5$ ($d \le F_L/5$). However, if the LED module 110 is positioned at the focal plane FP of the lens 130 (i.e., "d"=0), thereby causing chips of the LED module 110 to be clearly imaging on the projection surface RP. Therefore, in another embodiment of this disclosure, the distance "d" between the focal plane FP and the LED module 110 satisfies the following equation (4):

$$(2F_L \tan\theta - L)/2 \tan 65° \le d \le (2F_L \tan\theta - L)/2 \tan 55° \quad (4)$$

According to equation (1), half of the viewing angle $\theta_L$ of the LED module 110 satisfies the following equation (5):

$$\theta_L = \tan^{-1}[(2F_L \tan\theta - L)/2d] \quad (5)$$

When the LED module 110 is in compliance with the characteristics of Lambertian light source, half of the viewing angle $\theta_L$ of the LED module 110 ranges from about 55° to about 65°. When two thresholds of $\theta_L$ (i.e., 55°; 65°) are considered and put into the equation (5), the expression of relation: $55° \leq \tan^{-1}[(2F_L \tan\theta - L)/2d] \leq 65°$ is obtained, and then equation (4) is found.

In particular, referring to FIG. 3, half of the "angle of intersection" θ is associated with half of the viewing angle $\theta_L$ of the LED module 110 in compliance with the equation (4). Therefore, the distance "d" between the focal plane FP and the LED module 110 can be defined via the focal length $F_L$, the maximum width L of the light-emitting surface 112, and the characteristics of Lambertian light source, thereby enabling the present embodiment forming a broad and soft light pattern without any surface treatments upon the lens 130.

In practice, the focal length $F_L$ of the lens 130 ranges from about 44.5 millimeters to about 57.5 millimeters, and the lens 130 has a Numerical Aperture ranging from about 0.5 to about 0.55. With this regard, one or more embodiments equipped with the LED headlight 100 are able to consume lower power. In addition, one or more embodiments equipped with the LED headlight 100 do not necessitate any reflector inside so that there is more space to utilize.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An LED headlight comprising:

a lens comprising a focal length and a focal plane, wherein the focal plane extends from a focal point of the lens and is perpendicular to an optical axis of the lens;

a heat sink disposed along the optical axis of the lens, and a distance between the heat sink and the lens is greater than a distance between the focal point and the lens;

at least one LED module disposed along the optical axis of the lens and in contact with the heat sink, a distance between the LED module and the lens is greater than the distance between the focal point and the lens; and a shelter disposed along the focal plane and configured to block part of light beams emitted from the LED module, wherein the LED module has an light-emitting surface equipped with a maximum width, which satisfies:

$0.0351F_L \leq L \leq 0.7279F_L$, wherein L represents the maximum width of the light-emitting surface, and $F_L$ represents the focal length of the lens, wherein a virtual line is formed between a first intersection of an outermost emitted light of the LED module and the focal plane and a second intersection of an object principal plane and the optical axis of the lens, and an angle of intersection between the virtual line and the optical axis of the lens satisfies;

$$2F_L \tan\theta = L + 2d \tan\theta_L$$

wherein θ represents half of the angle of intersection between the virtual line and the optical axis of the lens, $\theta_L$ represents half of the viewing angle of the LED module, d represents a distance between the focal plane and the LED module, wherein the distance (d) between the focal plane and the LED module satisfies:

$$(2F_L \tan\theta - L)/2 \tan 65° \leq d \leq (2F_L \tan\theta - L)/2 \tan 55°.$$

2. The LED headlight of claim 1, wherein the distance between the focal plane and the LED module is smaller than or equal to one fifth of the focal length of the lens.

3. The LED headlight of claim 1, wherein half of the viewing angle of the LED module ranges from about 55° to about 65°.

4. The LED headlight of claim 1, wherein half of the angle of intersection between the virtual line and the optical axis of the lens is about 20°.

5. The LED headlight of claim 1, wherein the focal length of the lens ranges from about 44.5 millimeters to about 57.5 millimeters.

6. The LED headlight of claim 1, wherein the lens has a Numerical Aperture ranging from about 0.5 to about 0.55.

7. The LED headlight of claim 1, wherein when the LED module emits light along the optical axis of the lens onto a projected plane, a luminous intensity on an intersection of the optical axis of the lens and the projected plane is smaller than or equal to 1700 candelas.

8. The LED headlight of claim 1, wherein when the LED module emits light along the optical axis of the lens onto a projected plane, a luminous intensity on an intersection of the optical axis of the lens and the projected plane is greater than or equal to 5100 candelas.

9. The LED headlight of claim 8, wherein the light emitted from the LED module onto the projected plane forms a cut-off line, which is a line to make a distinction between a bright zone and a dark zone of a light pattern on the projected plane, an included angle between the cut-off line and a horizontal line on the projected plane is about 15°.

10. An LED headlight comprising:

a lens comprising a focal length and a focal plane, wherein the focal plane extends from a focal point of the lens and is perpendicular to an optical axis of the lens;

a heat sink disposed along the optical axis of the lens, and a distance between the heat sink and the lens is greater than a distance between the focal point and the lens;

at least one LED module disposed along the optical axis of the lens and in contact with the heat sink, a distance between the LED module and the lens is greater than the distance between the focal point and the lens; and a shelter disposed along the focal plane and configured to block part of light beams emitted from the LED module, wherein a virtual line formed between a first intersection of an outermost emitted light of the LED module and the focal plane, and a second intersection of an object principal plane and the optical axis of the lens, an angle of intersection is formed between the virtual line and the optical axis of the lens, wherein a distance between the focal plane and the LED module satisfies:

$$(2F_L \tan\theta - L)/2 \tan 65° \leq d \leq (2F_L \tan\theta - L)/2 \tan 55°$$

wherein $F_L$ represents the focal length of the lens, θ represents half of the angle of intersection between the virtual line and the optical axis of the lens, d represents the distance between the focal plane and the LED module, L represents a maximum width of an light-emitting surface on the LED module.

* * * * *